US007228897B2

(12) United States Patent
Holt, Jr. et al.

(10) Patent No.: US 7,228,897 B2
(45) Date of Patent: Jun. 12, 2007

(54) CEMENT THROUGH SIDE POCKET MANDREL

(75) Inventors: James H. Holt, Jr., Conroe, TX (US); Walter R. Chapman, Kingwood, TX (US); James H. Kritzler, Pearland, TX (US); Jeffrey L. Osselburn, Houston, TX (US); Keith E. Lewis, Bangkok (TH)

(73) Assignee: Baker Hughes Incorporated, Houston, TX (US)

( * ) Notice: Subject to any disclaimer, the term of this patent is extended or adjusted under 35 U.S.C. 154(b) by 153 days.

(21) Appl. No.: 10/676,134

(22) Filed: Oct. 1, 2003

(65) Prior Publication Data

US 2004/0112599 A1 Jun. 17, 2004

Related U.S. Application Data

(60) Provisional application No. 60/415,393, filed on Oct. 2, 2002.

(51) Int. Cl.
*E21B 33/00* (2006.01)

(52) U.S. Cl. ..... 166/177.4; 166/117.5

(58) Field of Classification Search ..... 166/117.5, 166/177.4

See application file for complete search history.

(56) References Cited

U.S. PATENT DOCUMENTS

| | | | | |
|---|---|---|---|---|
| 2,923,357 A | | 2/1960 | Daffin | 166/102 |
| 3,014,533 A | | 12/1961 | Moore, Jr. | 166/224 |
| 3,050,121 A | | 8/1962 | Garrett et al. | 166/46 |
| 3,130,784 A | | 4/1964 | Pennington, II | 166/42 |
| 3,603,393 A | | 9/1971 | Terral et al. | 166/242 |
| 3,741,299 A | | 6/1973 | Terral | 166/117.5 |
| 3,807,499 A | | 4/1974 | Tausch et al. | 166/242 |
| 4,106,563 A | * | 8/1978 | Gatlin et al. | 166/117.5 |
| 4,106,564 A | * | 8/1978 | Tausch | 166/117.5 |
| 4,197,909 A | * | 4/1980 | Terral | 166/117.5 |
| 4,201,265 A | * | 5/1980 | Thomason et al. | 166/117.5 |
| 4,498,533 A | | 2/1985 | Johnston | 166/117.5 |
| RE32,441 E | | 6/1987 | Higgins et al. | 166/117.5 |
| 4,673,036 A | | 6/1987 | Merritt | 166/117.5 |
| RE32,469 E | | 8/1987 | Merritt et al. | 166/117.5 |
| 4,759,410 A | | 7/1988 | Benker et al. | 166/117.5 |
| 5,137,085 A | | 8/1992 | Goode | 166/117.5 |
| 5,181,566 A | | 1/1993 | Barneck | 166/117.5 |
| 5,862,859 A | | 1/1999 | Speed et al. | 166/117.5 |
| 6,068,015 A | | 5/2000 | Pringle | 137/155 |
| 6,070,608 A | | 6/2000 | Pringle | 137/155 |
| 6,082,455 A | | 7/2000 | Pringle et al. | 166/250.15 |
| 6,230,812 B1 | | 5/2001 | Reaux | 166/378 |

* cited by examiner

*Primary Examiner*—David Bagnell
*Assistant Examiner*—Nicole Coy
(74) *Attorney, Agent, or Firm*—Madan, Mossman & Sriram, P.C.

(57) ABSTRACT

Well completion cement may be pumped through a side pocket mandrel that includes parallel rows of filler sections to exclude cement from void space within the side pocket tube. The filler sections are drilled with cross-flow jet channels and surface upsets to stimulate scrubbing turbulence by well working fluid behind a cement wiper plug. The wiper plug includes leading and trailing groups of wiper discs secured to an elongated shaft. The two wiper groups are separated by a distance that permits the leading seal group to gain traction seal before the push seal on the trailing wiper group is lost. A spring centralizer spans a center section of the shaft between the two wiper groups to maintain axial alignment of the shaft as the plug traverses the length of a mandrel.

16 Claims, 3 Drawing Sheets

CEMENT THROUGH SIDE POCKET MANDREL

This application claims the priority of U.S. Provisional Patent Application Ser. No. 60/415,393 filed Oct. 2, 2002.

BACKGROUND OF THE INVENTION

1. Field of the Invention

The present invention relates to methods and apparatus for subterranean well completion. In particular, the invention relates to the manufacture, operation and use of side pocket mandrel tools that accommodate a through-bore flow of cement and enhance a turbulent flow of well working fluid behind the cement wiper plug within the side pocket mandrel as the plug is driven past the mandrel.

2. Description of the Prior Art

Side pocket mandrels are special purpose tubing sections assembled along a production tubing string within a subterranean well for producing fluid such as crude petroleum and natural gas. These special purpose tube sections include relatively short cylindrical barrels (side pockets) in parallel axis alignment with the primary tubular bore axis but laterally off-set therefrom. These side pockets have a bore opening within the tube section interior and an aperture between the barrel interior and the exterior of the mandrel wall. These side pockets constitute receptacles for fluid flow control devices such as valves or property measuring instruments. In the case of valves, fluid flow from the tubing bore into the well annulus or vice versa is controlled.

By means of wireline suspension structures, valve elements may be placed in or removed from the side pockets without removing the tubing string from the well. These flow control options are of great value to well production managers.

Another aspect of well production control that is facilitated by side pocket mandrels is gas lifting. There are many petroleum reservoirs holding vast quantities of petroleum fluids having insufficient internal driving force to raise the native fluid to the surface. Because of the reservoir depth, traditional pumping is not an option. In these cases, the formation fluids may be extracted by means of gas lifting.

There are numerous gas lifting techniques but, in general, a compressible fluid such as nitrogen, carbon dioxide or an external source of natural gas is compressed into the well annulus and selectively admitted into the production tubing bore via side pocket valves. A pressure differential rising of the gas flow within the tubing bore to the surface may be exploited to aspirate a petroleum flow along with the lift gas or to drive a plug along the tubing bore having a column of liquid petroleum above the plug.

When a well is first opened, the reservoir may have sufficient internal driving energy to produce a commercially adequate flow of the formation fluid to the surface. In time, however, that internal energy source may be dissipated long before the reservoir value is depleted. Production experience may anticipate such production developments by positioning side pocket mandrels in the production tube long before the actual need for gas lifted production. When the need for gas lifting arises, the only downhole operations required to begin gas lifting are the wireline placement of the gas lift valve elements in the respective side pockets. When compared to the enterprise of withdrawing and returning several miles of production tubing or coil tubing in a well, wireline procedures are minimal.

Such considerations are more imperative in those cases in which much of the well bore remains uncased. Extremely deep or long, horizontal well bores are examples. For example, a long well bore may be completed with minimum casing length. Below the casing, the raw borehole remains uncased through the formation production face. Completion of the well may include a single "trip" placement of production tube with cross-over and cementing valves. The well annulus between the production tube and borehole wall is cemented above the production zone for isolation. Production flow from the production zone is opened by perforating the production tube and surrounding cement annulus.

Unfortunately, a single trip completion with side pocket mandrels for later gas lifting, for example, has not previously been an available option. Delivery of the cement slurry down the production tube bore unreasonably contaminates the internal labyrinth of the side pocket mandrel.

It is an object of the present invention therefore, to provide a side pocket mandrel that may be cleaned of cement before it sets.

Another object of the invention is a method of single trip well completion that includes pre-positionment of side pocket mandrels that will be operatively available for subsequent gas lift operation.

Also an object of the invention is an apparatus for scouring the flow bore of a side pocket mandrel of cement or other contaminant.

SUMMARY OF THE INVENTION

The invention objectives are accomplished by a side pocket mandrel construction having internal guide and flow vane structure along an internal channel that accommodates the physical alignment and clearance of pocket valve elements. The guide and vane structure comprises a plurality of elongated arc sectors within the mandrel interior flanking the side pocket clearance space. Surface relief, upsets and undercuts into the arc sector surfaces stimulate fluid turbulence for flushing residual cement from the mandrel interior. Cross-flow jet apertures within the arc sector bodies enhance the turbulent generation.

The arc sectors are secured to the mandrel wall, preferably by welding through apertures in the tubing wall. These arc sectors are aligned as parallel rails along opposite sides of a tool clearance channel. The tool clearance channel provides a minimum width required by the valve element and kick-over tool to place and remove and valve element with respect to the bore of the side pocket cylinder.

Used in operational cooperation with the present side pocket mandrel is a cement wiper plug having a pair of longitudinally separated groups of wiper discs. The wiper disc groups are separated by a distance that is proportional to the mandrel length whereby the wiper plug is driven by fluid pressure behind either the leading or trailing wiper group as the side pocket section of the mandrel is traversed. Between the two wiper disc groups, is a centralizer to maintain axial alignment of the shaft linking the two wiper disc groups as the mandrel is traversed.

The fluid pressure driving the wiper plug to push the major bulk of cement from the side pocket mandrel interior often is a light, low viscosity fluid such as water. As fluid flow behind the plug traverses the mandrel, a turbulent flow state within the mandrel is induced by critical fluid flow rates over the arc sector surface profiles and through jet channels across the arc sector widths. Such turbulent flow scrubs and flushes the cement residual from the mandrel interior before the cement is permitted to set.

BRIEF DESCRIPTION OF THE DRAWINGS

For a thorough understanding of the present invention, reference is made to the following detailed description of the preferred embodiments, taken in conjunction with the accompanying drawing wherein like reference numbers designate like or similar elements throughout the several figures of the drawing and.

DETAILED DESCRIPTION OF THE PREFERRED EMBODIMENTS

Figure 1:
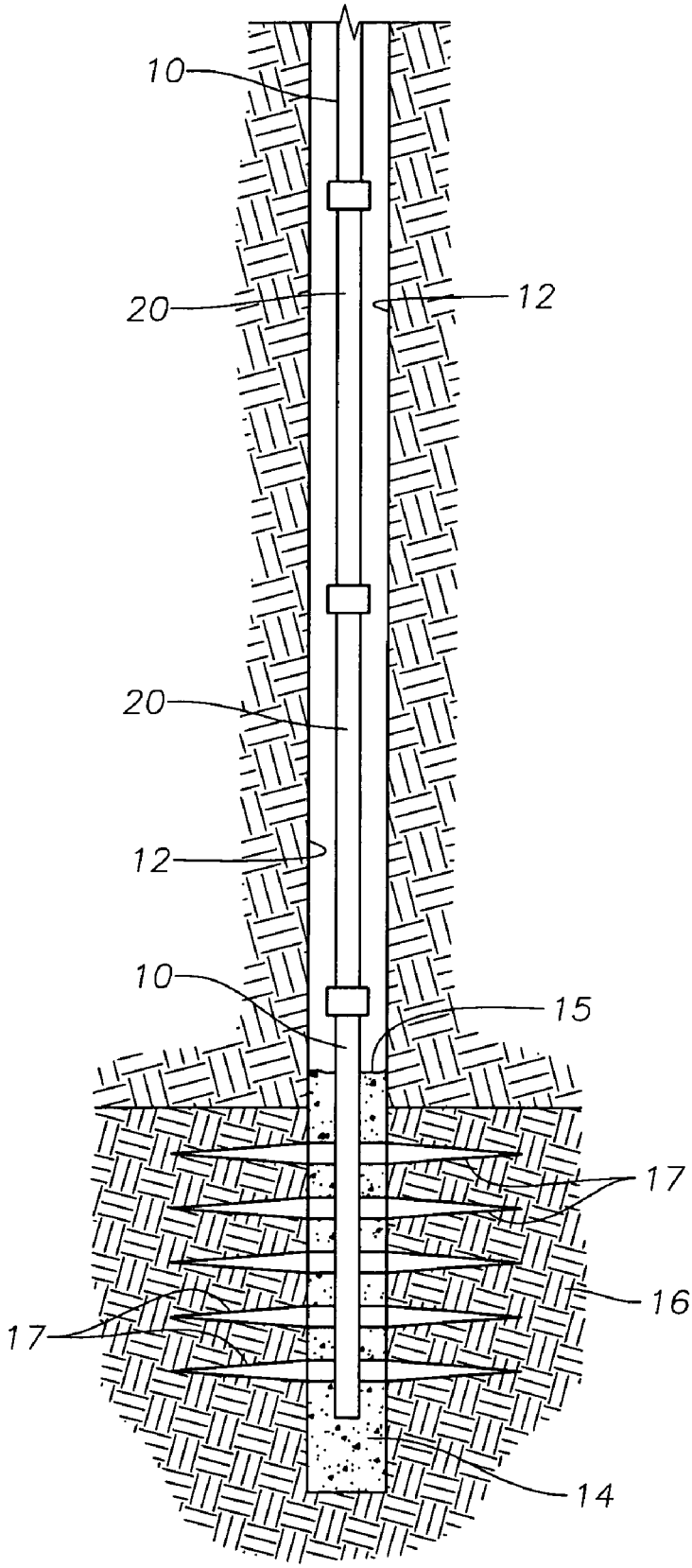
FIG. 1 is a borehole schematic representing a gas lift application of the invention.

A representative environment of the invention is illustrated by FIG. 1 wherein a production tube 10 is cemented in an open well bore 12 by a cement annulus collar 14. The length of cemented annulus 14 extends into or through an economic production zone 16. After the cement is placed and set, the tube and collar section is perforated by chemically or explosively formed fissures 17 that extend into the formation 16. These fissures 17 provide fluid flow conduits from the in situ formation zone 16 into the flow bore 18 of the production tube 10.

Located along the length of the production tube 10 above the upper face 15 of the cement collar 14 are one or more side pocket mandrels 20 according to the present description. Procedurally, when the tube 10 is positioned in the open borehole, a measured quantity of cement is pumped down the tube flow bore 18. When the measured quantity of cement is in the tube bore 18 as a standing fluid column, the trailing or upper face of the tubing confined cement column is capped by a wiper plug 50 such as that illustrated by FIG. 5. The wiper plug is inserted into the tubing flow bore 18 against the trailing cement face 15 while the trailing face is at or near the surface or wellhead. The tubing string is reconnected to the working fluid circulation system and water or other well working fluid is pumped behind the wiper plug 50 to push the cement down the tube bore 18 and back up the wellbore annulus. Frequently, a plug seat is placed at the terminal end of the tubing string 10 to engage the wiper plug 50 and seal the bottom end of the tubing string 10.

The exact location of the collar upper face 15 may therefore be determined with considerable precision. Similarly, the required location of the mandrels 20 along the length of the tubing string 10 may also be precisely determined.

Traversal of the wiper plug through each mandrel displaces most of the cement that has entered the mandrel during the annulus cementing operation. Nevertheless, residual cement remains in the mandrel void spaces that are essential work space for inserting and removing side pocket valves, plugs and instruments. Should this residual cement be allowed to set within a mandrel, the utility of the mandrel is essentially destroyed. The inability of the prior art to adequately clean this work space has prevented side pocket mandrels from be used as in the manner previously described. With respect to the present invention, however, as the well working fluid behind the wiper plug 50 flows through each mandrel of the present invention, the working flow behind the traveling wiper plug induces turbulent velocities and flow patterns within a mandrel to scrub and flush each mandrel free of residual cement.

Figure 2:
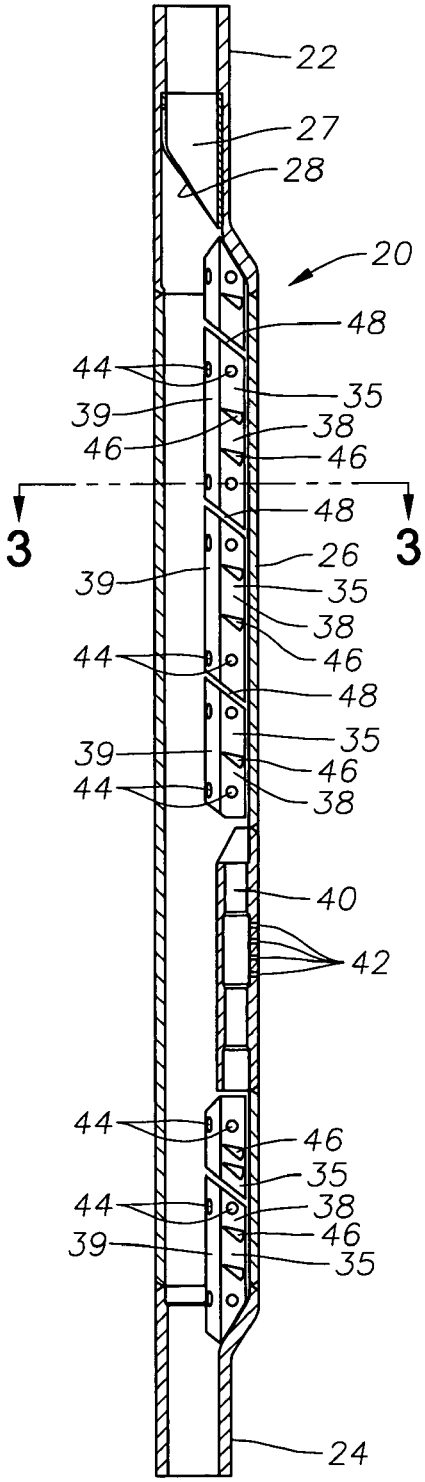
FIG. 2 is a longitudinal cross-section of a side pocket mandrel fabricated in accord with the invention principles.
Figure 3:
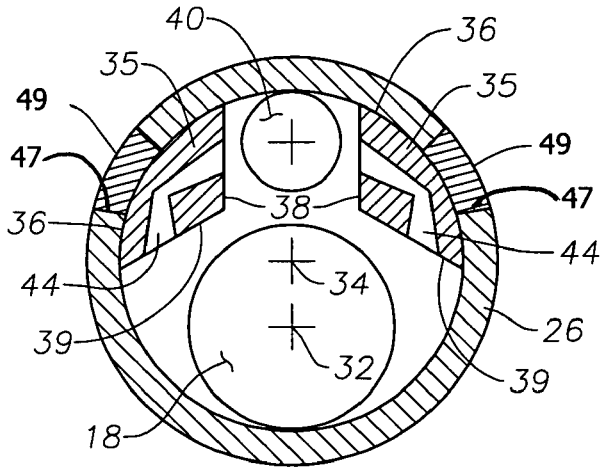
FIG. 3 is a transverse cross-section of the FIG. 2 mandrel as viewed along cutting plane 3—3 of FIG. 2; and, FIG. 4 is a pictorial view of a mandrel guide section; and, FIG. 5 is a partially sectioned elevation of the present wiper plug.
Figure 4:
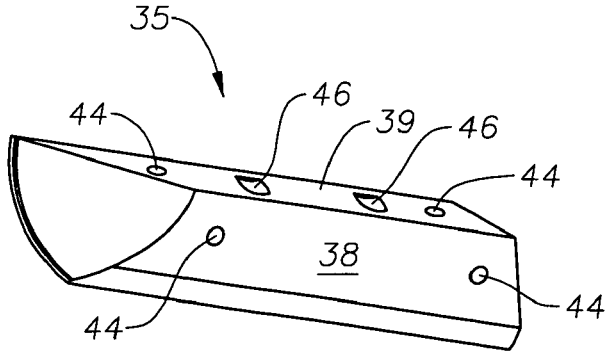

Referring to FIG. 2, each side pocket mandrel 20 in the tubing string 10 comprises a pair of tubular assembly joints 22 and 24, respectively, at the upper and lower ends. The distal ends of the assembly joints are of the nominal tubing diameter as extended to the surface and are threaded for serial assembly. Distinctively, however, the assembly joints are asymmetrically swaged from the nominal tube diameter at the threaded ends to an enlarged tubular diameter. In welded assembly, for example, between and with the enlarged diameter ends of the upper and lower assembly joints is a larger diameter pocket tube 26. Axis 32 respective to the assembly joints 22 and 24 is off-set from and parallel with the pocket tube axis 34 (FIG. 3).

Within the sectional area of the pocket tube 26 that is off-set from the primary flow channel area 18 of the tubing string 10 is a valve housing cylinder 40. The cylinder 40 is laterally penetrated by external apertures 42 through the external wall of the pocket tube 26. Not illustrated by FIG. 2 or FIG. 3 is a valve or plug element that is placed in the cylinder 40 by a wireline manipulated device called a "kickover" tool. For wellbore completion, side pocket mandrels are normally set with side pocket plugs in the cylinder 40. Such a plug interrupts flow through the apertures 42 between the mandrel interior flow channel and the exterior annulus and masks entry of the completion cement. After all completion procedures are accomplished, the plug may be easily withdrawn by wireline tool and replaced by a wireline with a fluid control element.

At the upper end of the mandrel 20 is a guide sleeve 27 having a cylindrical cam profile for orienting the kickover tool with the valve cylinder 40 in a manner well known to those of skill in the art.

Set within the pocket tube area between the side pocket cylinder 40 and the assembly joints 22 and 24 are two rows of filler guide sections 35. In a generalized sense, these filler guide sections are formed to fill much of the unnecessary interior volume of the side pocket tube 26 and thereby eliminate opportunities for cement to occupy that volume. Additionally, the filler guide sections 35 provide a mass object that prevents a cement wiper plug from entering the spaces that the sections 35 occupy, thereby preventing the wiper plug from becoming stuck in such spaces. Of equal but less obvious importance is the filler guide section function of generating turbulent circulations within the mandrel voids by the working fluid flow behind the wiper plug.

Similar to quarter-round trim molding, the filler guide sections 35 have a cylindrical arc surface 36 and intersecting planar surfaces 38 and 39. The opposing face separation between the surfaces 38 is determined by clearance space required by the valve element inserts and the kick-over tool.

Surface planes 39 serve the important function of providing a lateral supporting guide surface for the wiper plug 50 as it traverses the side pocket tube 26 and keep the leading wiper elements within the primary flow channel 18.

Each of the filler guide sections 35 is secured within the pocket tube 26 by one or more filler welds 49. Apertures 47 are drilled or milled through the wall of the pocket tube 26 to provide welder access to the face of the arc surface 36.

At conveniently spaced locations along the length of each filler section, cross flow jet channels 44 are drilled to intersect from the faces 38 and 39. Also at conveniently spaced locations along the surface planes 38 and 39 are indentations or upsets 46. Preferably, adjacent filler guide sections 35 are separated by spaces 48 to accommodate different expansion rates during subsequent heat treating procedures imposed on the assembly during manufacture. If deemed necessary, such spaces 48 may be designed to further stimulate flow turbulence.

Figure 5:
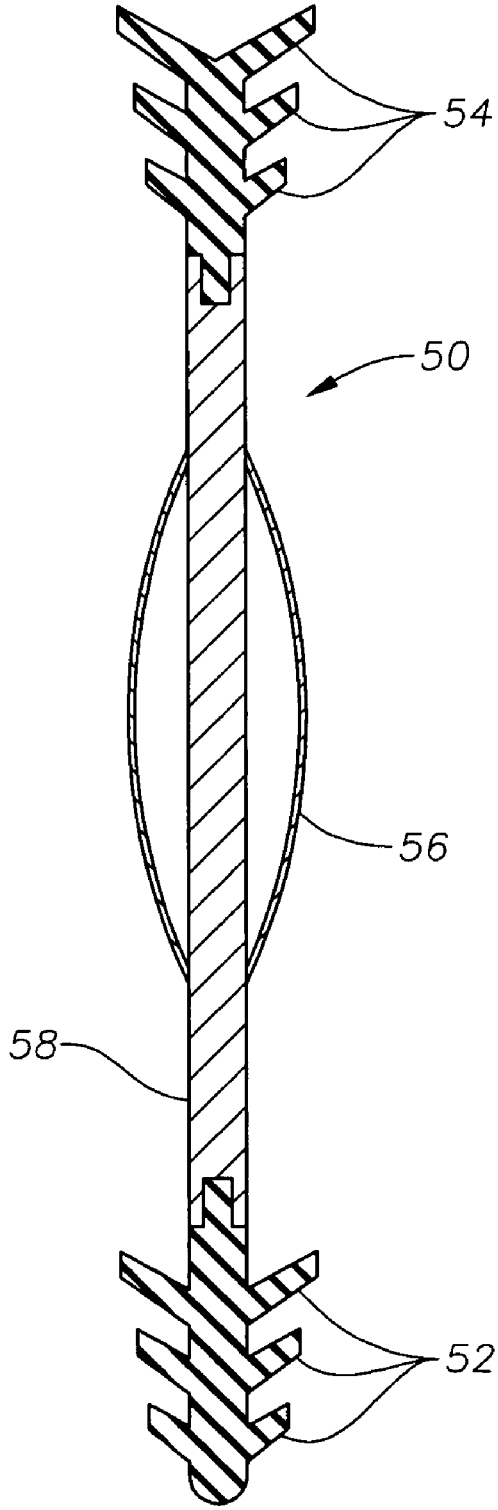

The wiper plug 50 utilized with the subject side pocket mandrel is schematically illustrated by FIG. 5. A significant distinction this wiper plug makes over similar prior art devices is the length. The plug 50 length is correlated to the distance between the upper and lower assembly joints 22 and 24. Wiper plug 50 has leading and trailing wiper disc groups 52 and 54. Between the leading and trailing groups is a spring centralizer 56.

As the leading wiper disc group 52 enters a side pocket mandrel 20, fluid pressure seal behind the wiper discs is lost but the filler guide planes 39 keep the leading wiper group 52 in line with the primary tubing flow bore axis 18. The trailing disc group 54 is, at the same time, still in a continuous section of tubing flow bore 18 above the side pocket mandrel 20. Consequently, pressure against the trailing group 54 continues to load the plug shaft 58. As the wiper plug progresses through a mandrel 20 under the compressive force of group 54, the spring centralizer 56 maintains the axial alignment of the shaft 58 midsection. By the time the trailing disc group 54 enters the side pocket mandrel 20 to lose drive seal, the leading seal group 52 has reentered the bore 18 below the mandrel 20 and regained a drive seal. Consequently, before the trailing seal group 54 loses drive seal, the leading seal group 52 has secured traction seal.

Although the invention has been described in terms of specified embodiments which are set forth in detail, it should be understood that the description is for illustration only and that the invention is not necessarily limited thereto, since alternative embodiments and operating techniques will become apparent to those of ordinary skill in the art in view of the disclosure. Accordingly, modifications are contemplated which can be made without departing from the spirit of the described and claimed invention.

The invention claimed is:

1. A side pocket mandrel comprising:

a. an axially elongated tube having an enlarged diameter section b. an inner volume formed in said enlarged diameter section e. a filler material positioned in said inner volume, said filler material preventing cement from occupying a substantial volume within said inner volume while also allowing placement of a valve element, wherein the filler material comprises surface discontinuities that comprise transverse jet channels formed to induce fluid flow turbulence.

2. A side pocket mandrel as described by claim 1, wherein said filler material comprises a plurality of guide sections.

3. A side pocket mandrel as described by claim 1 further comprising a cylinder bore enclosure positioned in said inner volume.

4. A side pocket mandrel as described by claim 3, wherein at least one of said guide sections is positioned axially below said cylinder bore enclosure.

5. A side pocket mandrel comprising:

a. an axially elongated tube having an enlarged diameter section b. an inner volume formed in said enlarged diameter section c. a filler material positioned in said inner volume, said filler material preventing cement from occupying a substantial volume within said inner volume while also allowing placement of a valve element, wherein said filler material comprises a plurality of independent increments and wherein each of said independent increments of filler material is separated from adjacent increments.

6. A side pocket mandrel as described by claim 5 wherein said filler material comprises surface discontinuities formed to induce fluid flow turbulence.

7. A side pocket mandrel as described by claim 6 wherein said surface discontinuities comprise surface upsets.

8. A side pocket mandrel as described by claim 5 wherein each of said independent increments of filler material is welded to a tube wall enclosing said inner volume.

9. A side pocket mandrel as described by claim 5 wherein said filler material is aligned in substantially parallel rows on opposite sides of said workspace channel.

10. A production string producing a fluid from a wellbore drilled in a subterranean formation, comprising: (a) a production tube adapted to be at least partially cemented in the wellbore; and (b) at least one mandrel positioned along said production tubing, the mandrel having an enlarged diameter section, a filler material positioned in said inner volume, said filler material preventing cement from occupying a substantial volume within said inner volume while also allowing placement of a valve element, wherein said filler material comprises a plurality of independent increments and wherein each of said independent increments of filler material is separated from adjacent increments.

11. The production string of claim 10, wherein the at least one mandrel includes an upper and a lower assembly joint each having a diameter smaller than a diameter of the enlarged diameter section, said upper and lower assembly joints separated by a length selected to maintain a pressure on a plug traveling through said mandrel.

12. The production string of claim 11 further comprising a guide positioned in said mandrel, said guide keeping said plug within a primary flow bore axis of said mandrel.

13. The production string of claim 11 further comprising a guide positioned in said mandrel, said guide keeping said plug within a primary flow bore axis of said mandrel.

14. The production string of claim 10 wherein said enlarged diameter section includes a channel for insertion of a valve element into said valve housing.

15. The production string of claim 10 wherein said enlarged diameter section has an interior volume that includes a surface discontinuity that induces the fluid flow turbulence.

16. The production string of claim 10 wherein said surface discontinuity includes one of (i) surface upsets, (ii) indentations, and (iii) transverse jet channels.

* * * * *